US010851523B2

(12) United States Patent
Parzynski, Jr. et al.

(10) Patent No.: US 10,851,523 B2
(45) Date of Patent: Dec. 1, 2020

(54) RETENTION SYSTEM FOR MOTOR GRADER BITS

(71) Applicant: Caterpillar Inc., Deerfield, IL (US)

(72) Inventors: David Bruno Parzynski, Jr., Peoria, IL (US); Thomas Marshall Congdon, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/180,958

(22) Filed: Nov. 5, 2018

(65) Prior Publication Data

US 2020/0141092 A1 May 7, 2020

(51) Int. Cl.
*E02F 9/28* (2006.01)

(52) U.S. Cl.
CPC ..... *E02F 9/2833* (2013.01); *E02F 9/2808* (2013.01)

(58) Field of Classification Search
CPC ..... E02F 3/8152; E02F 9/28; E02F 9/2833; E02F 9/2808; E01C 35/193; E01C 35/1933; E01C 35/1936
See application file for complete search history.

(56) References Cited

U.S. PATENT DOCUMENTS 594,896 A * 12/1897 Palmer ..... E21C 35/1936 299/103
2,612,361 A * 9/1952 Hagenbook ..... E21C 27/126 299/85.1
4,076,318 A * 2/1978 Hauschopp ..... E21C 27/44 299/103
4,299,424 A 11/1981 Lebegue et al.
4,335,921 A * 6/1982 Swisher, Jr. ..... E21C 35/197 299/103
4,753,299 A * 6/1988 Meyers ..... E02F 9/2825 172/701.3
4,883,129 A 11/1989 Lonn et al.
D308,684 S * 6/1990 Meyers ..... D15/28
5,007,685 A * 4/1991 Beach ..... E21C 35/1933 299/103
5,094,398 A * 3/1992 Jeter ..... B05B 13/0278 239/134
5,720,528 A 2/1998 Ritchey
5,992,405 A 11/1999 Sollami
6,024,143 A * 2/2000 Ritchey ..... A01G 23/067 144/24.12
6,202,327 B1 * 3/2001 Fuller ..... E01H 5/12 37/220

(Continued)

FOREIGN PATENT DOCUMENTS

CN 108487367 9/2018
DE 102005055544 A1 5/2007
WO 2017023804 2/2017

*Primary Examiner* — Robert E Pezzuto
(74) *Attorney, Agent, or Firm* — Miller & Matthias & Hull

(57) ABSTRACT

A tool bit is disclosed. The tool bit includes a working portion at a distal end of the tool bit, a threaded portion at a proximal end of the tool bit, a shank extending along a longitudinal axis of the tool bit between the working portion and the threaded portion, and an anti-rotation receiving hole located on the threaded portion. The anti-rotation receiving hole extends through the threaded portion transverse to the longitudinal axis. The threaded portion of the tool bit is configured to engage with threads of a nut, and the anti-rotation receiving hole is configured to receive a pin inserted through the nut.

17 Claims, 6 Drawing Sheets

(56) References Cited

U.S. PATENT DOCUMENTS

| | | | | |
|---|---|---|---|---|
| 6,203,049 | B1 * | 3/2001 | Gibson | A01B 59/042 280/494 |
| 7,299,836 | B2 * | 11/2007 | Green | A01G 23/067 144/176 |
| 7,997,056 | B2 * | 8/2011 | Segura | B66C 1/10 59/78 |
| 8,061,386 | B2 * | 11/2011 | Mueller | E03C 1/0404 137/801 |
| 8,528,990 | B2 | 9/2013 | Latham | |
| 8,534,766 | B2 * | 9/2013 | Ritchey | E21C 35/1936 299/106 |
| 9,212,553 | B2 * | 12/2015 | Sollami | E21C 35/18 |
| 9,551,217 | B2 * | 1/2017 | Ries | E21C 35/1933 |
| 9,687,997 | B2 | 6/2017 | Micacchi | |
| 10,046,479 | B2 * | 8/2018 | Lehnert | E21C 35/19 |
| 10,125,471 | B2 * | 11/2018 | Congdon | A01B 35/26 |
| 10,385,690 | B2 * | 8/2019 | Roth | E21C 35/19 |
| 2012/0019044 | A1 | 1/2012 | Monyak | |
| 2015/0130258 | A1 * | 5/2015 | Sollami | E21C 35/18 299/79.1 |
| 2015/0300166 | A1 | 10/2015 | Ries et al. | |
| 2016/0229084 | A1 | 8/2016 | Lehnert et al. | |
| 2018/0171586 | A1 * | 6/2018 | Congdon | E02F 3/815 |
| 2018/0195255 | A1 | 7/2018 | Parzynski et al. | |
| 2018/0266578 | A1 * | 9/2018 | Baxter | F16K 24/04 |

* cited by examiner

RETENTION SYSTEM FOR MOTOR GRADER BITS

TECHNICAL FIELD

The present disclosure generally systems and methods of retaining bits, and more particularly, to a system for securing motor grader bits in an adapter board of a motor grader machine.

BACKGROUND

Work machines, such as motor graders, may have ground engagement members (e.g., wheels or tracks) to drive the machine over the ground. A motor grader may be equipped with a tool, such as a blade, to bear against the ground over which it is driven. In some applications, the grader is equipped with a series of bits instead of a blade to better cut and break up the ground. In such a configuration, the blade is replaced with an adapter board, or mold board, that secures the bits.

Retention of the bits into the moldboard may be performed with applying nuts or snap rings on a back side of the bits. Under operating conditions, vibration of the machine may cause for loosening of the bit retention mechanisms. Further, snap rings may be difficult to install and may become lost during operation. The snap rings may become lost due to material buildup, improper installation, and the like. Without the snap ring for retention, the cutting bit may fall out of the moldboard and be lost.

U.S. Pat. No. 4,883,129A entitled Bit Assembly Utilizing Carbide Insert, provides for a ground engaging bit used in abrasive road grading applications. Due to wear, carbide inserts in the tips often break requiring replacement. The '129 patent provides for a means for retaining the bit assembly that includes a retaining ring located in a groove of a shank on the bit.

While arguably effective for its intended purpose there is still need for improved retention of motor grader tool bits.

SUMMARY

In accordance with one aspect of the present disclosure, a tool bit includes a working portion at a distal end of the tool bit, a threaded portion at a proximal end of the tool bit configured to receive a fastener, and a shank extending along a longitudinal axis of the tool bit between the working portion and the threaded portion. In some such embodiments, the fastener is a nut and the threaded portion comprises threads on an outer surface of the threaded portion, the threads configured to receive a nut. In such an embodiment, the tool bit may further include an anti-rotation receiving hole located on the threaded portion. The anti-rotation receiving hole extends through the threaded portion transverse to the longitudinal axis. The threaded portion of the tool bit is configured to engage with threads of a nut, and the anti-rotation receiving hole is configured to receive a pin inserted through the nut. In another such embodiment, the threaded portion comprises an internally threaded portion configured to receive a retention bolt.

In another aspect of the present disclosure, a system for securing a tool bit includes a tool bit having a working portion at a distal end of the tool bit, a threaded portion at a proximal end of the tool bit, a shank extending along a longitudinal axis of the tool bit between the working portion and the threaded portion, and an anti-rotation receiving hole located on the threaded portion. The securing system further includes a nut configured to engage with the threaded portion of the tool bit and a cotter pin to be inserted through the anti-rotation receiving hole and the nut. In some embodiments, the nut may be a castle nut having a plurality of slots circumferentially disposed about the nut and threads configured to engage with the threaded portion of the tool bit, and a pin. In a secured configuration, the shank of the tool bit is inserted through the bore hole of the adapter board, the threaded portion extends from the bore hole into the clearance region, the threads of the nut are engaged with the threaded portion of the tool bit, the pin is inserted through two opposing slots of the plurality of slots of the nut and the anti-rotation receiving hole, and the tail ends of the pin are deformed around the nut.

In such an embodiment, the system may further include a washer. In such an embodiment, when in the secured configuration, the washer is disposed about the shank of the tool bit between the nut and the leading edge of the adapter board. In another such embodiment, the anti-rotation receiving hole is drilled into the threaded portion. In yet another embodiment, when in a the secured configuration, the nut is hand-tightened to engage the threaded portion of the tool bit. In yet another embodiment of the present disclosure, a tool bit includes a shank extending along a longitudinal axis of the tool bit, the shank having an internally threaded portion configured to receive a retention bolt, and a working portion at a distal end of the tool bit. The working portion of the tool bit includes an anti-rotation segment having a flat side configured to engage an anti-rotation slot of an adapter board. In one such embodiment, the shank of the tool bit may be configured not to extend through a bore hole of the adapter board. When in a secured configuration, a washer is disposed about a bolt, the bolt is threaded into the internally threaded portion of the tool bit, and the bolt is torqued into the internally threaded portion with a wrench.

These and other aspects and features of the present disclosure will be more readily understood when read in conjunction with the accompanying drawings.

DETAILED DESCRIPTION

Figure 1:
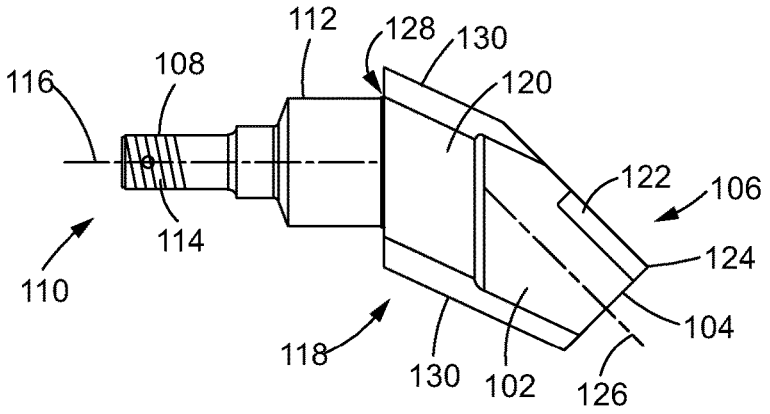
FIG. 1 is a side-view of a first tool bit, in accordance an embodiment of the present disclosure.

Referring now to the drawings, and with specific reference to FIG. 1, a tool bit is disclosed. In particular, FIG. 1 depicts the side view 100 of the tool bit 102. A working portion 104 is located at a distal end 106 of the tool bit 102. A threaded portion 108 is located at a proximal end 110 of the tool bit 102. A shank 112, and the threaded portion 108, extend along a longitudinal axis 116. The working portion 104 extends along the working-portion axis 126. In some embodiments, the working portion 104 does not extend along the same axis as the longitudinal axis, such as depicted in the view 100 of the tool bit 102. Here, the working portion 104 is angled down and to the right along the working-portion axis 126 as compared to the longitudinal axis 116. As such, the longitudinal axis 116 and the working-portion axis 126 intersect. The difference in angle between the longitudinal axis 116 and the working-portion axis 126 provide for proper engagement of the working portion 10 with a ground surface (not depicted). At the working portion 104, a cutting surface 122 may be have a planar shape and be realized by a carbide tip, a tungsten carbide tip, or the like. While the cutting surface 122 may be designed to be durable, it may be desirable for a tool bit securing system to provide for replacement of individual tool bits on a machine due to wear experienced during operations.

At the proximal end 110, the tool bit 102 includes a threaded portion 108. The threaded portion 108 is configured to receive a fastener. In some embodiments, such as those depicted in FIG. 1, the threaded portion 108 includes threads on an outer surface of the threaded portion (e.g., is externally threaded). In such embodiments, the fastener may be realized by a nut, a castle nut, or the like. In other embodiments, discussed in conjunction with FIGS. 8 and 9, the threaded portion 108 may be realized by an internally threaded portion 808 and the fastener may be realized by a retention bolt 804. Returning to the discussion of FIG. 1, the threaded portion 108 includes an anti-rotation receiving hole 114. In some embodiments, the anti-rotation receiving hole 114 is drilled into the threaded portion 108 and is transverse to the longitudinal axis 116. The location of the anti-rotation receiving hole 114 may be placed at a location along the longitudinal axis 116 to permit engagement with a pin 302 that is disposed between slots 206 of a nut 202.

At the end of the shank 112 away from the proximal end 110, the tool bit 102 transitions to a shoulder 128 that includes a larger cross-sectional area than that of the shank 112. The shoulder 128 is configured to abut against an adapter plate in response to a force applied along the longitudinal axis 116 (e.g., by a nut 202 engaging with the threaded portion 108 or by the working portion 104 being engaged with the ground surface).

In some embodiments, the tool bit 102 includes an anti-rotation segment 118. As depicted in the view 100, the anti-rotation segment 118 may be realized by a flat side 120. Here, the tops and the bottoms of the tool bit may be realized as having rounded surfaces 130. However, the flat side 120 is configured to abut against an anti-rotation slot 602 on a leading edge 514 of an adapter board 506. The flat-surface to flat-surface engagement between the flat side 120 and the anti-rotation slot 602 prevent the tool bit 102 from rotating about its longitudinal axis 116.

In some embodiments, the anti-rotation segment 118 includes two parallel flat surfaces on opposing sides of the tool bit. Each of the flat surfaces may engage with the anti-rotation slot 602 to prevent rotation of the tool bit 102 when secured into the adapter board 506. In other embodiments, the anti-rotation segment 118 may include keying to ensure that the tool bit 102 is installed in the correct orientation when secured to the adapter board 506. For example, the tool bit 102 may have an anti-rotation segment 118 having a flat surface 120 on a first side of the tool bit 102 and a rounded portion 130 on the opposite side of the tool bit. The anti-rotation slot 602 may be complementarily designed to allow full insertion of the tool bit 102 into the adapter board 506 only when the tool bit 102 is properly oriented.

Figure 2:
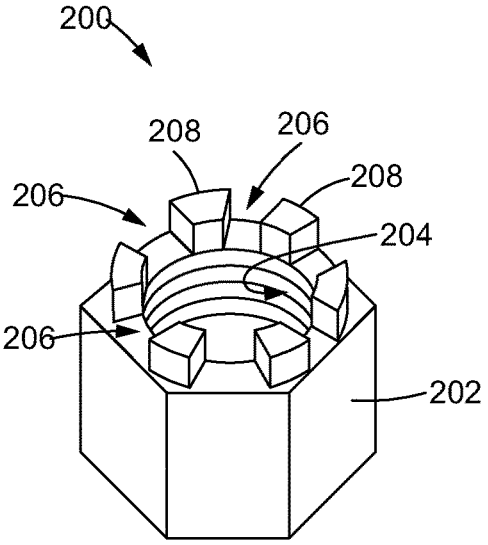
FIG. 2 is a perspective view of a nut, in accordance with an embodiment of the present disclosure.

FIG. 2 is a perspective view of a nut, in accordance with an embodiment of the present disclosure. In particular, FIG. 2 depicts the perspective view 200 of the nut 202. In some embodiments, the nut 202 is a castle nut having the features depicted in the view 200. The nut 202 includes threads 204 located about an inner circumference of the nut 202. The threads 204 are configured to engage with the threaded portion 108 of the tool bit 102. In such an embodiment, the nut 202 may have the same diameter opening as the threaded portion 108 and be machined with threads of a pitch that complement the threads of the threaded portion 108. The nut 202 further includes a plurality of slots 206 disposed between a plurality of upright members 208. The upright members 208 are positioned such that the slots 206 are configured to receive a pin 302 being inserted through the anti-rotation receiving hole 114.

Figure 3:
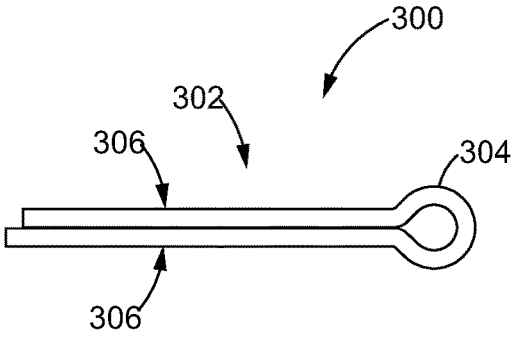
FIG. 3 is a side view of a pin, in accordance with an embodiment of the present disclosure.

FIG. 3 is a side view of a pin, in accordance with an embodiment of the present disclosure. In particular, FIG. 3 is a perspective view 300 of the pin 302. The pin 302 may be adapted to be inserted through the anti-rotation receiving hole 114 and a nut 202. The pin 302 includes an eyelet 304 on the right portion of the view 300 and two tail ends 306 on the left side of the view 300 that are able to be deformed. The dimension across the eyelet (e.g., the eyelet diameter) may be selected to be larger than a diameter of the anti-rotation receiving hole to prevent the pin 302 from being pulled through the anti-rotation receiving hole 114.

In some embodiments, the pin 302 may be realized as a cotter pin. In other such embodiments, the pin 302 may be realized by a piece of lock wire inserted through the anti-rotation receiving hole 114, with ends of the lock wire twisted together to secure the lock wire into the anti-rotation receiving hole 114.

Figure 4:
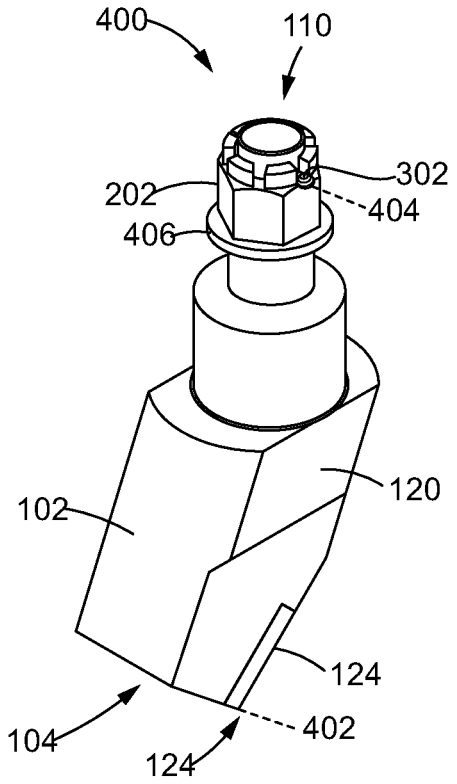
FIG. 4 is a perspective view of the first tool bit engaged with a nut, in accordance with an embodiment of the present disclosure.

FIG. 4 is a perspective view of the first tool bit engaged with a nut, in accordance with an embodiment of the present disclosure. In particular, FIG. 4 depicts the perspective view 400 that includes the tool bit 102 with a washer 406 disposed about the threaded portion 108, a nut 202 engaged with the threaded portion 108, and a pin 302 inserted through both the slots 206 of the nut 202 and the anti-rotation receiving hole 114. As depicted in FIG. 4, the anti-rotation receiving hole 114 extends along the axis 404. The tool bit 102 also includes the cutting surface 122 having a working edge 124. The working edge 124 extends along the axis 402. In some embodiments, the axis 402 of the working edge 124 is parallel to the axis 404 of the anti-rotation receiving hole 114. As such, when installing a pin 302 into the anti-rotation receiving hole 114 (e.g., in a tool bit securing system), the orientation of the anti-rotation receiving hole 114 may permit increased access to the anti-rotation receiving hole 114 in relation to other obstructions (e.g., adapter plate, mold board). In other embodiments, the anti-rotation receiving hole 114 is drilled into the threaded portion 108 of the tool bit 102 such that its axis 404 is not parallel to the axis 402 of the working edge 124. Such alternate orientations may be selected based on expected obstructions adjacent to the clearance region 510.

Figure 5:
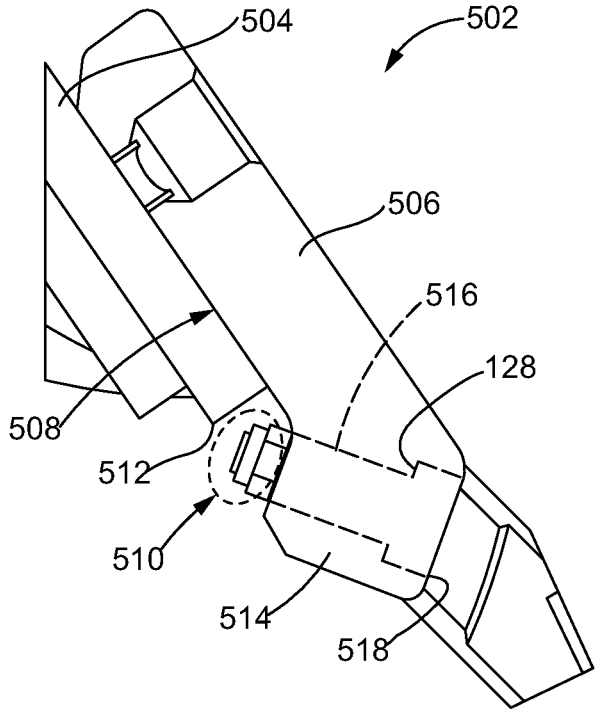
FIG. 5 is side view of a tool bit securing system for the first tool bit, in accordance with an embodiment of the present disclosure.

FIG. 5 is side view of a tool bit securing system for the first tool bit, in accordance with an embodiment of the present disclosure. In particular, FIG. 5 is a side view 500 of the tool bit securing system 502 for the tool bit 102. The securing system 502 includes a mold board 504. In some embodiments, the mold board 504 is a portion of a motor grader machine (not depicted) and serves as an interface between the machine and the tool bits that interact with the ground surface. The mold board 504 attaches to a back surface 508 of an adapter board 506. The adapter board 506 includes a leading edge 514 that includes a bore hole 516. The bore hole 516 is configured and sized to receive the threaded portion 108 of the tool bit 102.

The leading edge 514 may be angled from the remainder of the adapter board 506 in order to provide a proper engagement angle of the working portion 104 of the tool bit 102 with the ground surface. As a result, a clearance region 510 is defined by a bottom edge 512 of the mold board 504 and a back surface 508 of the leading edge 514. The clearance region 510 provides for limited access to the threaded portion 108 of the tool bit. As such, it may be difficult to obtain proper room in the vicinity of the clearance region 510 in order to apply a torque wrench or a socket wrench to a nut in order to secure the tool bit 102 to the adapter board 506. Thus, it may be advantageous, but difficult, to torque an applied nut to the threaded portion 108 in order to minimize backing the off of nuts. The subsequent disengagement between the nuts and the threaded portion, due to vibrations experienced during operation, may cause loss of the tool bit 102.

As seen in FIG. 5, the tool bit 102 is inserted into the bore hole 516, which extends through the leading edge 514 from the clearance region 510 to the front surface 518 of the adapter board 506. The threaded portion 108 of the tool bit 102 extends into the clearance region 510, and the shank 112 is disposed within the bore hole 516. The shoulder 128 abuts against a surface of the adapter board 506, thus limiting the protrusion of the threaded portion 108 into the clearance region 510.

When the tool bit 102 is secured into the adapter board 506, the shank 112 of the tool bit 102 is inserted through the bore hole 516 of the adapter board 506, the threaded portion 108 extends from the bore hole 516 into the clearance region 510, the threads 204 of the nut 202 are engaged with the threaded portion 108 of the tool bit 102, the pin 302 is inserted through two opposing slots 206 of the plurality of slots of the nut 202 and the anti-rotation receiving hole 114.

The tail ends 306 of the pin 302 are deformed around the nut 202 and the eyelet 304 prevents the pin 302 from sliding through the anti-rotation receiving hole 114. The tail ends 306 are configured such that a first tail end 306 may be deformed in a clockwise direction around the nut 202 and the second tail end 306 may be deformed in a counter-clockwise direction around the nut 202.

The upright members 208 thus prohibit the nut 202 from rotating when the pin 302 is installed into the anti-rotation receiving hole 116 through the slots 206. It is envisioned that items other than a pin 302 may be inserted through the anti-rotation receiving hole 114 in order to prevent rotation of the nut 202. For example, lock wire may be inserted through the anti-rotation receiving hole 114 and twisted together to prevent the nut 202 from rotating.

Figure 6:
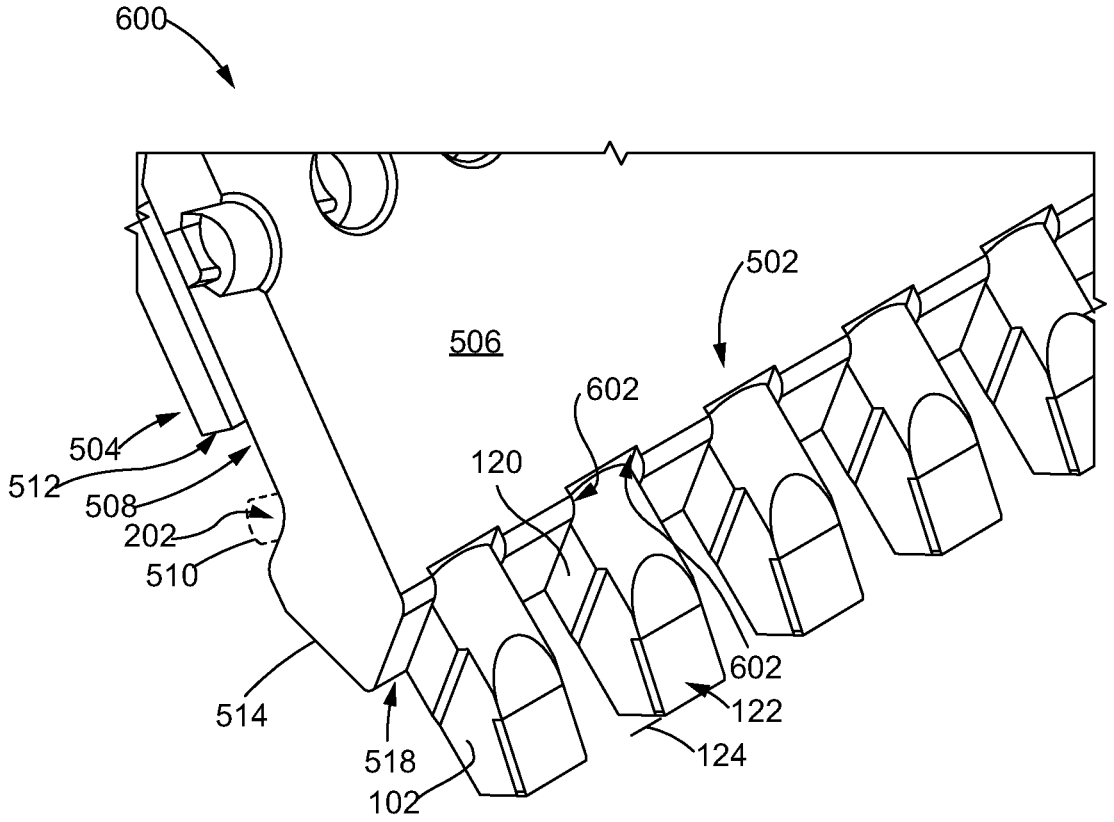
FIG. 6 is a perspective view of the front of a tool bit securing system, in accordance with an embodiment of the present disclosure.

FIG. 6 is a perspective view of the front of a tool bit securing system, in accordance with an embodiment of the present disclosure. In particular, FIG. 6 depicts the view 600 of the tool bit securing system 502. Here, a plurality of tool bits 102 are secured into the adapter board 506. In some embodiments, each of the tool bits 102 may be secured by the aspects disclosed related to the tool bit securing system 502. However, it is envisioned that in some embodiments only one tool bit 102 is secured via the system 502, while other types of tool bits, and their associated tool-bit securing systems, may be used to secure the other tool bits to the adapter board 506.

The adapter board 506 includes the anti-rotation slot 602. Here, the anti-rotation slot 602 is realized by flat surfaces on either side of the tool bit that interact with the anti-rotation segment 118 of the tool bit 102. For example, the tool bit 102 may include the flat side 120 that abuts against the anti-rotation slot 602 when secured into the adapter board 506. The engagement of the two flat surfaces prevents rotation of the tool bit 102 about its longitudinal axis 116.

In some embodiments, the tool bit 102 is secured via a nut 202 being hand-tightened to the threaded portion 108 of the tool bit 102. The hand-tight engagement prevents the tool bit 102 from translating along its longitudinal axis. However, the hand-tight engagement may not provide sufficient pressure between the tool bit 102 and the adapter board 506 to prevent rotation about its longitudinal axis 116 without incorporation of the anti-rotation segment 118 and the anti-rotation slots 602 of the adapter board 506.

Figure 7:
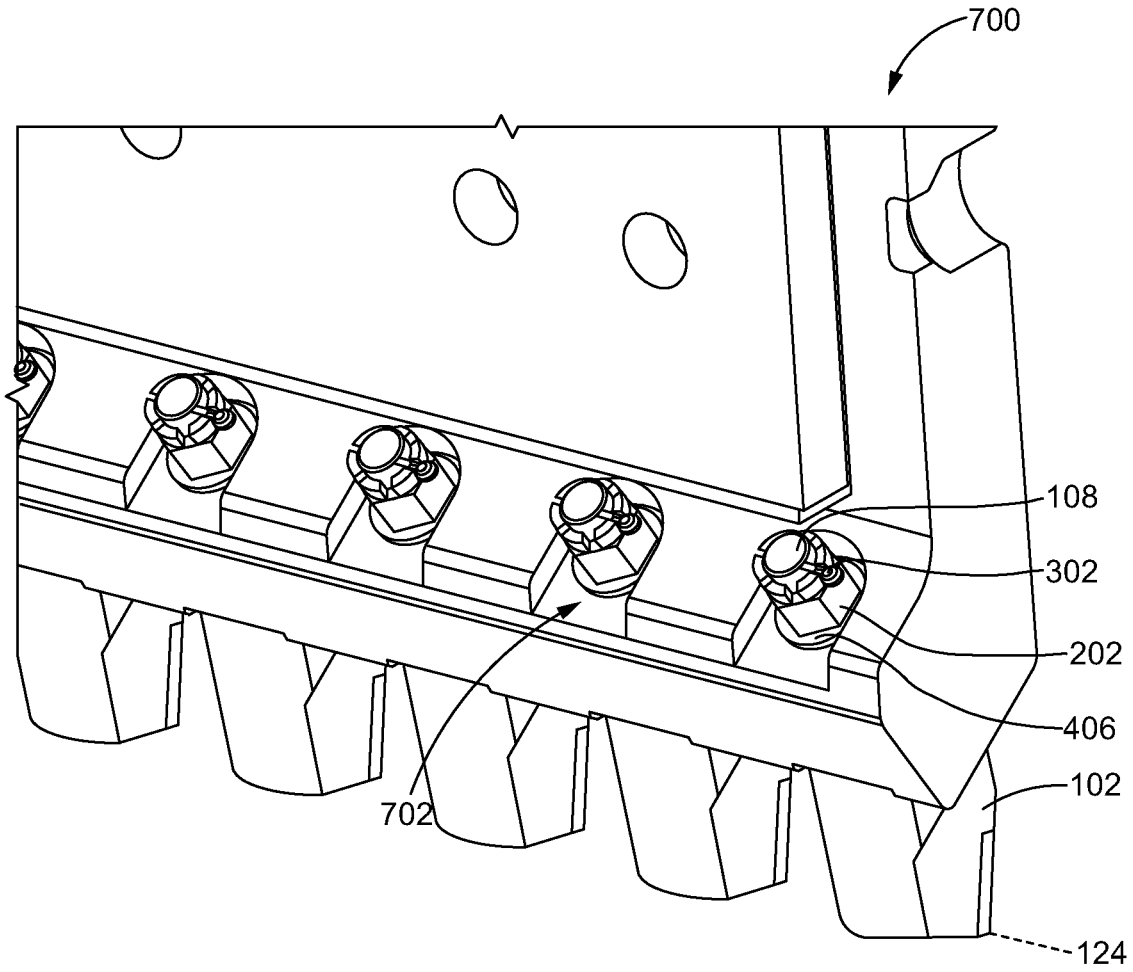
FIG. 7 is a perspective view of the back of the tool bit securing system, in accordance with an embodiment of the present disclosure.

FIG. 7 is a perspective view of the back of the tool bit securing system, in accordance with an embodiment of the present disclosure. In particular, FIG. 7 depicts the perspective view 700 of the back of the tool bit securing system 502 depicted in the view 600 of FIG. 6. Here, a nut 202 is engaged with the threaded portion 108 of the tool bit 102 that extends into the clearance region. A pin 302 is inserted through the anti-rotation receiving hole 114, and each of the pins 302 and their respective anti-rotation receiving holes 114 are oriented along an axis that is parallel to the axis of the working edge 124. As such, this orientation permits increased access by an installer to the tail ends 306 of the pins 302 when they are deformed about the nut 202.

In some embodiments, the securing system 502 further includes a washer 406 disposed about the threaded portion 108 of the tool bit 102 and between the nut 202 and the adapter board 506. The washer 406 may provide for a more uniform distribution of forces between the nut 202 and the adapter board 506.

In some other embodiments, the adapter board 506 may include cutouts 702 around the bore hole 516. The cutouts 702 provide for a larger clearance region 510 to permit increased access to the threaded portion 108 of the tool bit 102.

Figure 8:
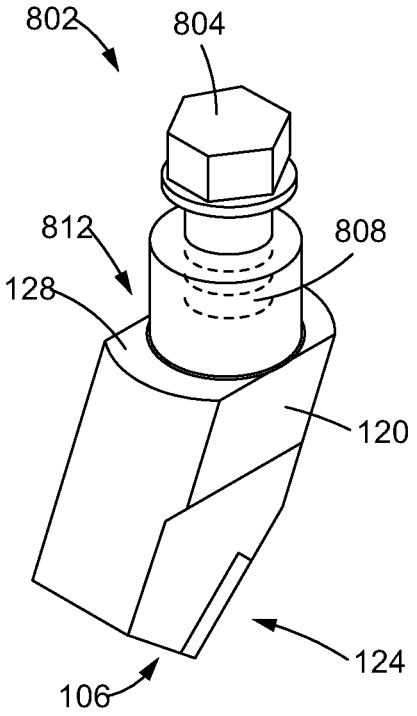
FIG. 8 is a perspective view of a tool bit, in accordance with an embodiment of the present disclosure.

FIG. 8 is a perspective view of a second tool bit, in accordance with an embodiment of the present disclosure. In particular, FIG. 8 depicts the view 800 of the tool bit 802. The tool bit 802 is similar to the tool bit 102. However, the threaded portion 108 includes threads on an inner surface (e.g., the internally threaded portion 808) that are configured to receive a retention bolt 804. The retention bolt 804 may be a threaded bolt, with its threads configured to engage with the internally threaded portion 808 of the tool bit 802. The distal end 106 of the tool bit 802 may be similarly designed as the distal end 106 of the tool bit 102, and thus include the cutting surface 122, the anti-rotation segment 118, the shoulder 128, and the like.

In such an embodiment, the shank 812 of the tool bit 802 is configured not to extend into the clearance region 510. To secure the tool bit 802 into the adapter board 506, the shank of the tool bit 802 may be inserted into the bore hole 516, a washer 406 may be disposed about the retention bolt 804, and the retention bolt 804 may be inserted into (e.g., threaded into) the internally threaded portion 808 of the tool bit 802 via access from the clearance region 510.

Due to the retention bolt 804 having a lower profile (e.g., it does not extend as far into the clearance region 510), the retention bolt 804 may be torqued with a tool (e.g., by a wrench or a socket) in order to provide sufficient tightness to prevent the retention bolt 804 from backing from vibrations experienced during normal operations. Such a system 802 provides for a reduction of parts as compared to tool bit securing system 502. This is because the system 802 does not require use of a pin 302 and replaces the nut 202 with the retention bolt 804. Further, the additional manufacturing step of drilling of an anti-rotation receiving hole 114 is also not required.

Figure 9:
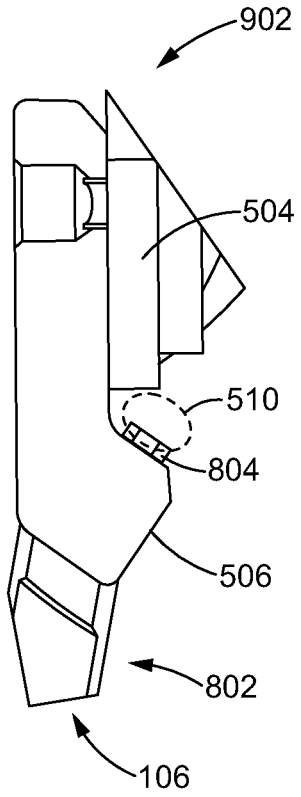
FIG. 9 is a side view of a tool securing system, securing the tool bit depicted in FIG. 8, in accordance with an embodiment of the present invention.

FIG. 9 is a side view of a tool securing system, securing the tool bit depicted in FIG. 8, in accordance with an embodiment of the present invention. In particular, FIG. 9 depicts the side view 900. The side view 900 is similar to the side view 500, but instead depicts the tool bit 802 being secured to the adapter board 506 with a retention bolt 804.

As depicted in the view 900, the head of the retention bolt 804 extends into the clearance region 510. The working portion 104 is similar to that of the working portion 104 of the tool bit 102.

INDUSTRIAL APPLICABILITY

In general, the teachings of the present disclosure may find applicability in many motor grader application. For instance, the teachings of the present disclosure may be applicable to any motor grader machines of differing sizes and orientations and for working on different road and ground surfaces.

Figure 10:
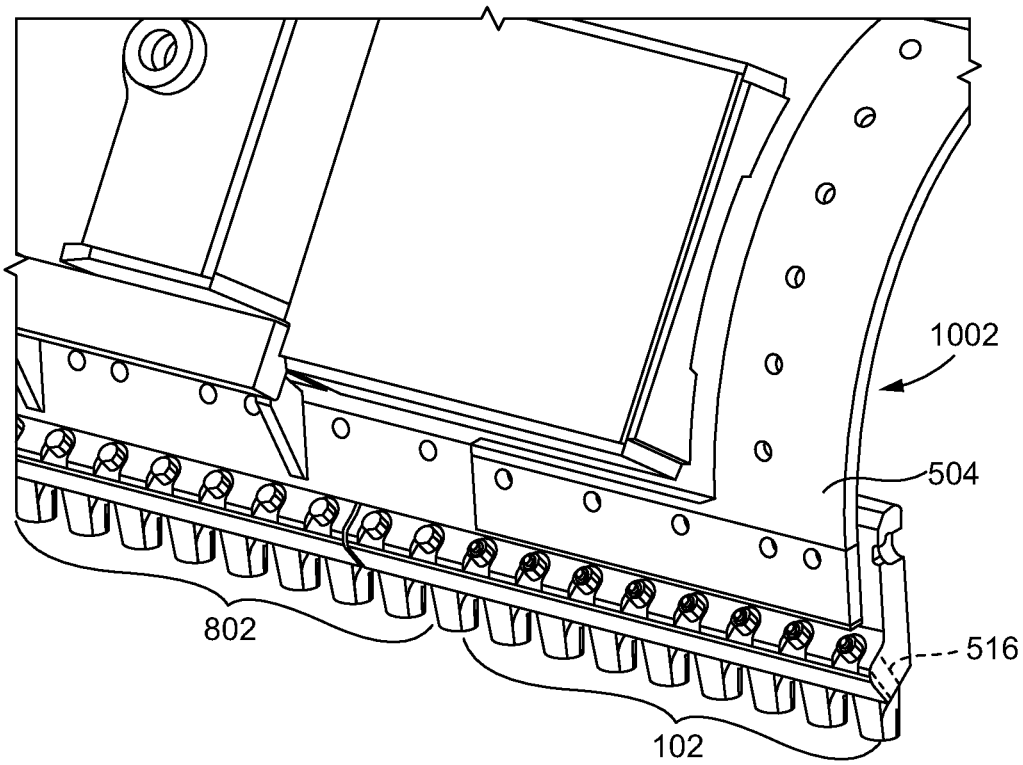
FIG. 10 is a perspective view of the rear of a motor grader having a plurality of tool bits secured to an adapter board, in accordance with an embodiment of the present disclosure.

FIG. 10 is a perspective view of the rear of a motor grader having a plurality of tool bits secured to an adapter board, in accordance with an embodiment of the present disclosure. In particular, FIG. 10 depicts the perspective view 1000 of the rear of the motor grader 1002 that implements the tool bit securing systems 502 and 902 to secure the respective tool bits 102 and 802.

Here, a portion of the mold board 504 on the right portion of the motor grader 1002 provides for a narrower clearance region 510 than does the center portion of the motor grader blade 1002. As such, the tool bits 102 are installed into the eight right-most bore holes 516 via the tool bit securing system 502. This includes a tool bit 102 having a threaded portion 108 configured being inserted through a respective bore hole 516 into the clearance region 510. A nut 202 is threaded onto the threaded portion 108 of the tool bit 102, and a pin 302 is inserted through the anti-rotation receiving hole 114 to restrain the nut 202 from rotating.

In the middle portion of the motor grader 1002, a larger clearance region 510 may exist as the attachment portion of the mold board 504 may not provide for such a limited size of the clearance region 510. As such, the tool bits 802 may be secured into the adapter board 506 via a retention bolt 804 engaging with the internally threaded portion 808 of the tool bit 802. These retention bolts 804 may be secured by torquing the retention bolts 804 with a torque wrench in order to sufficiently secure the tool bit 802 to the adapter board 506.

It is further envisioned that each bore hole 516 in the adapter board 506 may be configured to receive either of the tool bit 102 or the tool bit 802, thus permitting installation of any available tool bit (102 or 802) into the respective bore hole 516. While the view 1000 depicts a mixture of tool bits 102 and 802 being installed in to the motor grader 1002, it is envisioned that a motor grader 1002 may realize only one of the tool bit securing systems throughout the entirety of the bore hole 516 in the adapter board 506.

What is claimed is:

1. A tool bit comprising:

a working portion at a distal end of the tool bit, the working portion having a top and a bottom, the working portion comprising a cutting surface disposed at the top of the working portion, the working portion extending lengthwise along a working-portion axis disposed between the cutting surface and the bottom of the working portion, the working-portion axis angled downward from a longitudinal axis of the tool bit such that the top of the working portion extends below the longitudinal axis, the cutting surface disposed between the longitudinal axis and the working-portion axis, the cutting surface having a planar shape;

a threaded portion at a proximal end of the tool bit configured to receive a nut, wherein the threaded portion comprises threads on an outer surface of the threaded portion to receive the nut, the threaded portion centered about and extending along the longitudinal axis of the tool bit;

a shank extending along the longitudinal axis of the tool bit, the shank extending between the working portion and the threaded portion, wherein the longitudinal axis intersects the working-portion axis; and an anti-rotation receiving hole located on the threaded portion, the anti-rotation receiving hole extending through the threaded portion transverse to the longitudinal axis, wherein the threaded portion of the tool bit is configured to engage the threads of the nut and the anti-rotation receiving hole is configured to receive a pin inserted through the hole.

2. The tool bit of claim 1, wherein the nut is a castle nut and the anti-rotation receiving hole is configured to receive a cotter pin inserted between slots of the castle nut.

3. The tool bit of claim 1, the working portion further including an anti-rotation segment having a flat side, the anti-rotation segment configured to engage with an anti-rotation slot on a leading edge of an adapter board.

4. The tool bit of claim 3, wherein a working edge of the cutting surface is parallel to the anti-rotation receiving hole.

5. A securing system for a tool bit of a motor grader, the securing system comprising:

the tool bit having:

a working portion at a distal end of the tool bit, the working portion having a top and a bottom, the working portion comprising a cutting surface disposed at the top of the working portion, the working portion extending lengthwise along a working-portion axis disposed between the cutting surface and the bottom of the working portion, the working-portion axis angled downward from a longitudinal axis of the tool bit such that the top of the working portion extends below the longitudinal axis, the cutting surface disposed between the longitudinal axis and the working-portion axis, the cutting surface having a planar shape, the working portion including an anti-rotation segment that is a flat side configured to prevent rotation of the tool bit about the longitudinal axis;

a threaded portion at a proximal end of the tool bit configured to receive a fastener, the threaded portion centered about and extending along the longitudinal axis of the tool bit, the longitudinal axis intersecting the working-portion axis;

a shank extending along the longitudinal axis of the tool bit, the shank extending between the working portion and the threaded portion; and an anti-rotation receiving hole extending through the threaded portion transverse to the longitudinal axis, wherein the threaded portion of the tool bit is configured to engage with threads of a nut, and the anti-rotation receiving hole is configured to receive a cotter pin inserted through the nut;

the nut configured to engage with the threaded portion of the tool bit; and the cotter pin to be inserted through the anti-rotation receiving hole and the nut.

6. The securing system of claim 5, wherein:

the tool bit is configured to be installed through a bore hole located on a leading edge of an adapter board, the bore hole extending between a clearance region and a front surface of the adapter hoard, and the nut is configured to be installed in the clearance region defined by a bottom edge of a mold board and the leading edge of the adapter board.

7. The securing system of claim 6, herein the nut is a castle nut and the anti-rotation receiving hole is configured to receive the cotter pin inserted between slots of the castle nut.

8. The securing system of claim 5, wherein in a secured configuration:

the shank of the tool bit is inserted through a bore hole of an adapter board;

the threaded portion extends from the bore hole into a clearance region;

the threads of the nut are engaged with the threaded portion of the tool bit;

the cotter pin is inserted through two opposing slots of a plurality of slots of the nut and the anti-rotation receiving hole; and tail ends of the pin are deformed around the nut.

9. The securing system of claim 5, wherein a leading edge of an adapter board includes an anti-rotation slot configured to engage with the anti-rotation segment.

10. The securing system of claim 5, wherein a working edge of a cutting surface is parallel to the anti-rotation receiving hole.

11. The securing system of claim 5, further comprising a washer configured to be disposed about the shank of the tool bit.

12. The securing system of claim 6, wherein the securing system further includes the adapter board, wherein the tool bit is installed through a bore hole located on a leading edge of the adapter board and the nut is installed in the clearance region.

13. A tool bit comprising:

a shank extending along a longitudinal axis of the tool bit, the shank having an internally threaded portion configured to receive a retention bolt; and a working portion at a distal end of the tool bit, the working portion having a top and a bottom, the working portion comprising a cutting surface disposed at the top of the working portion, the working portion extending lengthwise along a working-portion axis disposed between the cutting surface and the bottom of the working portion, the working-portion axis angled downward from a longitudinal axis of the tool bit such that the top of the working portion extends below the longitudinal axis, the cutting surface disposed between the longitudinal axis and the working-portion axis, the cutting surface having a planar shape, the working portion having an anti-rotation segment having a flat side configured to engage an anti-rotation slot of an adapter board to prevent rotation about the longitudinal axis and the working-portion axis, wherein the working-portion axis intersects the longitudinal axis.

14. The tool bit of claim 13, wherein the shank of the tool bit is configured not to extend through a bore hole of the adapter board.

15. The tool bit of claim 13, wherein in a secured configuration, a washer is disposed about, the retention bolt, the retention bolt is threaded into the internally threaded portion of the tool bit, and the retention bolt is torqued into the internally threaded portion with a wrench.

16. The tool bit of claim 13, wherein the anti-rotation segment is configured to engage with an anti-rotation slot on a leading edge of an adapter board.

17. The tool bit of claim 13, wherein the tool bit is configured to be installed through a bore hole located on a leading edge of an adapter board, the bore hole extending between a clearance region and a front surface of the adapter board, the retention bolt is configured to be installed in the clearance region defined by a bottom edge of a mold hoard and a leading edge of the adapter board.

* * * * *